US006575110B1

(12) United States Patent
Nelson

(10) Patent No.: US 6,575,110 B1
(45) Date of Patent: Jun. 10, 2003

(54) DOCKING SLIP GUIDE

(76) Inventor: Douglas C. Nelson, 110 E. 1750 North, Orem, UT (US) 84057

( * ) Notice: Subject to any disclaimer, the term of this patent is extended or adjusted under 35 U.S.C. 154(b) by 0 days.

(21) Appl. No.: 09/995,915

(22) Filed: Nov. 27, 2001

(51) Int. Cl.[7] ..... B63B 59/02
(52) U.S. Cl. ..... 114/219; 114/231
(58) Field of Search ..... 114/44–48, 263, 114/266, 267, 219, 220, 231; 405/212–221

(56) References Cited

U.S. PATENT DOCUMENTS

| | | | | | |
|---|---|---|---|---|---|
| 18,683 | A | * | 11/1857 | Day | 114/231 |
| 2,900,946 | A | | 8/1959 | Walker | |
| 3,041,639 | A | | 7/1962 | Atlas | |
| 3,084,517 | A | | 4/1963 | Bell | |
| 3,145,685 | A | | 8/1964 | Kulick | |
| 4,103,925 | A | | 8/1978 | Palamara | |
| 4,318,362 | A | * | 3/1982 | Jung | 114/266 |
| 4,773,349 | A | * | 9/1988 | McKinney | 114/219 |
| 5,113,702 | A | | 5/1992 | Capps | |
| 5,911,189 | A | * | 6/1999 | Ryan | 114/230 |

* cited by examiner

*Primary Examiner*—Ed Swinehart
(74) *Attorney, Agent, or Firm*—Kenneth M. Jensen

(57) ABSTRACT

The invention is a guide to facilitate boat docking. The guide is a plate attached to the dock, angling away from the slip opening. Attached to the plate are rails which absorb energy and minimize friction when contact occurs while docking. Structural members attached to the plate allow its attachment to the dock, and support the plate against bending when boats contact the rails. Guides are typically attached to docks on each side of the slip, to facilitate docking with minimal effort, providing a wide opening which narrows as the boat enters the slip, directing the boat into the slip.

11 Claims, 7 Drawing Sheets

DOCKING SLIP GUIDE

BACKGROUND OF INVENTION

1. Field of the Invention

This invention relates generally to boat docks and slips. More particularly, the invention relates to devices which are attached to or fabricated as part of a dock, to guide boats smoothly into slips with a minimum of effort and damage.

Watercraft of various types are often stored on the water, moored in a slip with docks in front of and to each side of the boat. This is particularly true of large boats, including houseboats, cabin cruisers, pontoon boats and other marine vessels, which have size sufficient to make floating storage easier than repeatedly launching and removing them from the water. Docking of smaller boats and personal watercraft is also common, although not always for extended storage; Docking of any watercraft may be for only a short period of time, to facilitate refueling or obtaining supplies, or loading and unloading passengers or cargo. In any case, docking of watercraft is a difficult procedure.

Often, the boat to be stored must be maneuvered in close quarters, in windy conditions or rough water. To further complicate the docking operation, the opening or slip, which the boat will occupy is only minimally larger than the boat, which it will receive. Additionally, most boats, which are docked or stored on the water, are large in terms of both volume and mass, so their ability to navigate in nimble fashion as required in such circumstances is severely inhibited, even when guided by extremely skilled drivers. Even small boats with relatively small mass are difficult to navigate in close quarters at low speeds because precise turning is most effective when the drive mechanism is engaged.

The difficulty of guiding a boat into a slip under such conditions often leads to mishaps, most often including damage to the docks which form the slip and to the boat itself. Such occurrences are very costly to repair, particularly due to the fact that the docks are most often floating well away from shore, and slips or components are not easily detached for repair work. Boats of significant size to which such occurrences are likely are also very costly to repair, and it is quite inconvenient to remove them from the water and have them transported to an appropriate location for repair.

2. Description of Related Art

Due to the difficult nature of smoothly guiding a boat into a docking slip, many.efforts to improve the process have been tried with varied results.

For general background material concerning this invention, the reader is referred to the following U.S. Patents, each of which is hereby incorporated by reference in its entirety for the material contained therein. This reference to these patents is not intended as an admission of "prior art" by the applicant, but is intended only as a reference to related information.

U.S. Pat. No. 2,900,946 discloses a boat fender which receives the thrust of a boat during berthing, or while the boat is tied to the dock.

U.S. Pat. No. 3,041,639 discloses a multiple boat anchorage, which allows docking of multiple boats about one buoy for saving space.

U.S. Pat. No. 3,084,517 discloses a dock attachment, which both yields and rotates to yieldably guide a boat into position, protecting the boat and the dock from impact.

U.S. Pat. No. 3,145,685 discloses a shock absorbing bumper for boats and docks having elongate bumpers which are supported by torque rods, and which swing in an arc when engaged by a boat.

U.S. Pat. No. 4,103,925 discloses a boat trailer having wings, which guide the boat convergently between longitudinal rails during high wind or wave conditions.

U.S. Pat. No. 5,113,702 discloses a boat dock slip having a series of guards, which extend at various points from the dock into the slip to guide and steady the boat relative to the dock.

U.S. Pat. No. 5,911,189 discloses a boat guide for use in or along slips, which utilize elongated upright tubular members, each about an axle, for absorbing the shock of a boat.

SUMMARY OF INVENTION

The present invention is a boat slip guide. In the preferred embodiment, the guides will be fabricated and attached to an existing dock. In other embodiments, guides may actually be manufactured as part of the dock. Generally, guides will be attached to docks on both sides of a slip, which direct the boat gently into the slip where the boat will be temporarily or permanently stored.

The guide or guides, when attached to, or manufactured as part of a dock, provide significant advantages in guiding watercraft smoothly into their mooring slips.

It is therefore an object of the invention to provide a boat slip guide which guides the boat or marine vessel smoothly into the slip, even during inclement weather or other difficult docking conditions.

It is also an object of the invention to absorb energy when the guide and boat come into contact, to prevent damage to the guide, the boat, and the dock.

It is a further object of the invention to provide a boat slip guide which has a surface that extends at an angle beyond the end of the dock to guide the boat into the slip and absorb the energy of any impact which occurs as the boat is directed into the slip.

It is another object of the invention to provide a boat slip guide, which requires minimal effort beyond the normal guidance of the watercraft to cause it to enter the slip gently and completely.

It is yet another object of the invention to provide a boat slip guide, which eases the difficulty of guiding a boat or marine vessel into a dock opening or slip during heavy winds or waves which frequently occur in a marine environment.

These, together with other objects of the invention, are achieved by the novel features of the boat slip guide provided throughout the specification and in the claims. Reference to the drawings and the detailed description of the invention will provide the reader with additional information regarding the invention, its intended uses and advantages over the prior art, and the preferred embodiment of the invention.

BRIEF DESCRIPTION OF DRAWINGS

The invention will be clarified and additional objects will become apparent by reference to the detailed description and the drawings. Included as drawings are the following figures.

DETAILED DESCRIPTION

The present invention is a device for guiding watercraft gently into a boat dock or slip by correcting the direction of travel. This is accomplished by attaching to the dock an angled guide which directs the boat into the slip, preserving the boat and dock from direct impact damage. Problems of misalignment caused by heavy winds or waves, as well as the difficulty of steering boats precisely are therefore alleviated by the invention. The invention consists of a rigid plate, formed to angle outwardly from the dock ends, creating a funnel shape into which the front of the boat is directed. The guide generally extends upwardly and downwardly from the top surface of the dock, providing a large bearing surface to guide the boat into the slip. Attached to the angled plate are shock absorbing rails which are somewhat compliant, providing a means for absorbing impact or momentum from the boat upon contact. Structural members may be attached to the back surface of the plate, which facilitate attachment of the guide to the dock, and enhance the rigidity of the guide. The plate is generally made from steel, aluminum, or other rigid metals, although plastic or composite plates might also be formed which are suitable for the purpose. The shock absorbing rails are typically made of wood, plastic, composites, or similar materials. Such materials typically absorb energy without incurring significant damage, and reduce friction to allow sliding contact as the guide directs the boat into the slip. In the event that significant damage occurs to the rails, they are easily replaced without the entire dock or guide having to be replaced. Structural members attached to the backside of the plate may be made of metal, plastic, composites, or wood, or other durable structural materials. Generally, structural members are made from angle iron, steel or aluminum, due to their availability, price, and durability. The guide is assembled using standard fastening techniques, including welding, adhesives, and bolted joints, screws or other mechanical fasteners. Preferably, the shock absorbent materials are attached to the rigid plate using bolts, and the structural members are welded to the back of the plate, and to each other where they meet. Bolts or screws then attach the structural members to the dock surfaces. Additional description and details of the invention and the preferred embodiment of the invention will be described hereinafter.

Figure 1:
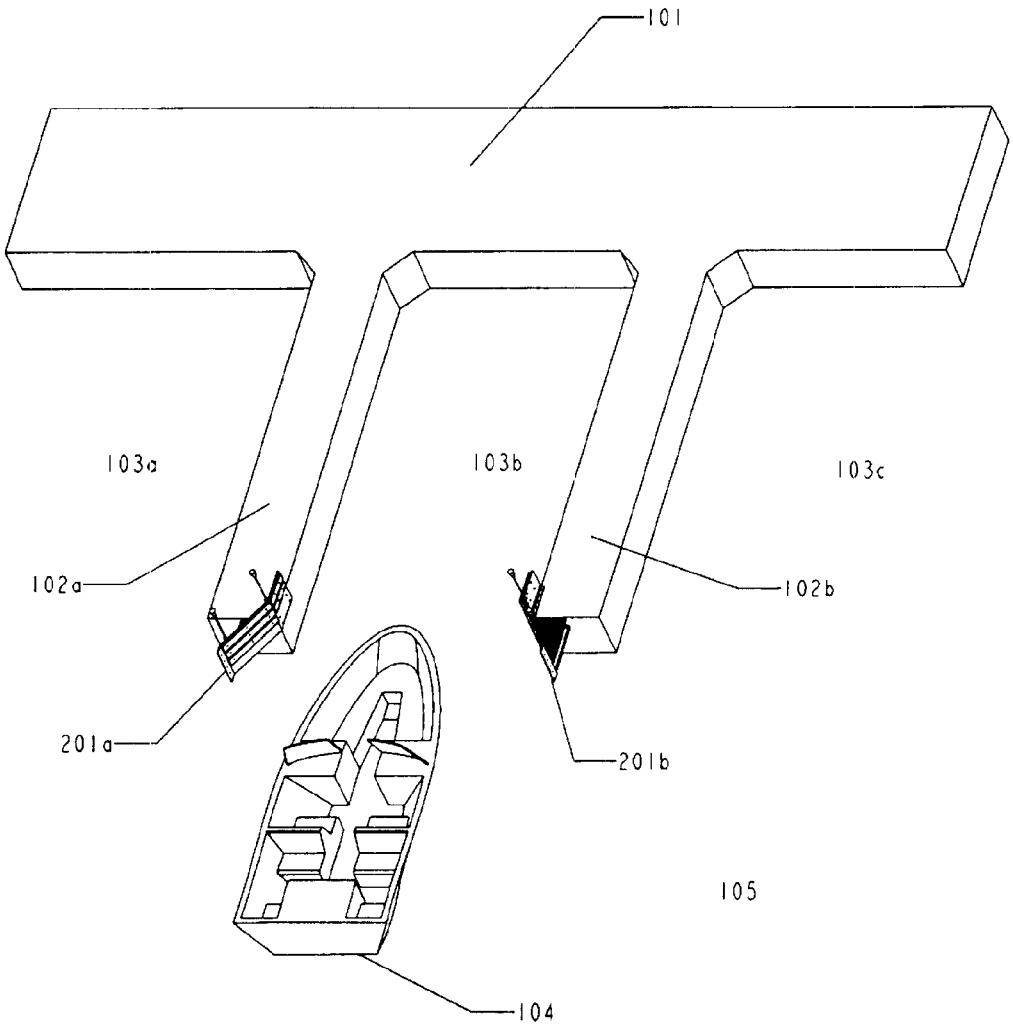
FIG. 1 is an isometric view of a boat dock equipped with the invention.

FIG. 1 shows a portion of a dock 101 with a center slip area 103*b* for boat storage. Attached to the left 102*a* and right 102*b* ends of the dock 101 are left 201*a* and right 201*b* angled guides to aid the guiding of the boat into the slip area 103*b*. On either side of dock ends 102*a* and 102*b* are additional slip areas 103*a* and 103*c*. A typical dock would have many slips areas defined by the dock 101 and dock ends 102*a* and 102*b*, although only one fully enclosed slip area 103*b* is shown for simplicity. A watercraft 104 is shown approaching the slip 103*b*. Left 201 a and right 201*b* angled guides are positioned on dock ends 102*a* and 102*b* to guide watercraft 104 properly into slip 103*b*. Water 105 surrounds the dock 101 and the watercraft 104.

Figure 2:
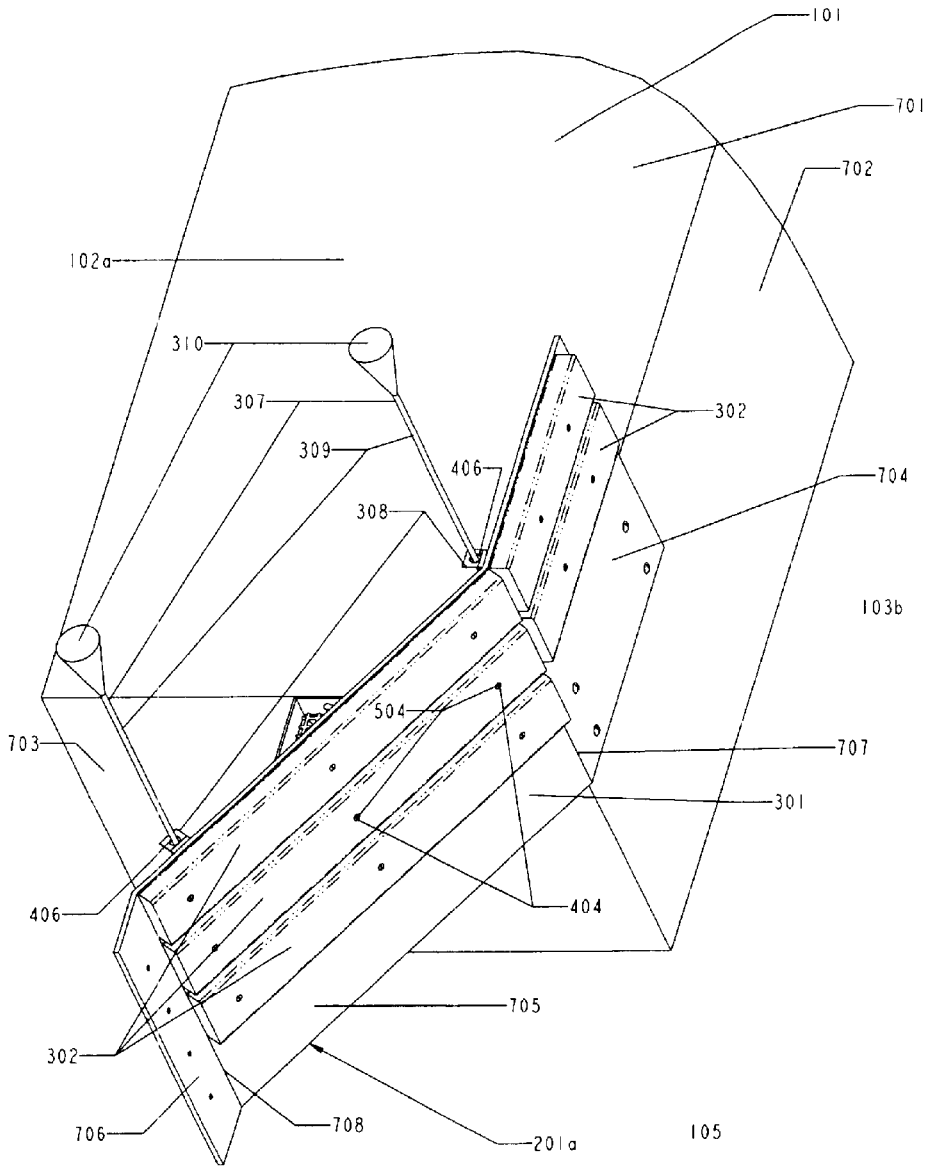
FIG. 2 is an enlarged isometric view of the end of a boat dock and the invention attached thereto.

FIG. 2 shows an enlarged view including the end 102*a* of the dock 101 to which is attached the left angled guide 201*a*. Included in this view are the individual components of the angled guide 201*a*. These components include a rigid plate 301, which conforms to the side surface 702 of the dock end 102*a*, and angles outwardly to guide the watercraft 104 (shown in FIG. 1) into the slip 103*b*. The plate 301 is formed with a bend 707 at the end surface 703 of the dock 101, which allows attachment to the side surface 702 of the end 102*a* of the dock 101. The plate 301 angles away from the slip 103*b*, and an additional bend 708 allows two guides to be secured together when mounted for use in adjacent slip 103*a*, as shown if FIGS. 8 and 9. The plate 301 then has three distinct planar surfaces. There are a side surface 704, an angled surface 705, and an extension surface 706. Attached to the rigid plate 301 are several energy absorbing rails 302 which allow sliding contact with the boat 104 as it enters the slip 103*b*. The energy absorbing rails 302 may be attached using adhesives or mechanical fasteners 504 which go through holes 404 in both plate 301 and rails 302. The rigid plate 301, which is attached to the dock 101, typically extends above and below the top surface 701 of the dock 101. Also part of the guide 201*a* are position markers 307 which extend above the rigid plate 301 to allow the driver to more easily ascertain the position of the watercraft 104 with respect to the angled guide 201*a*. Position markers 307 typically have a slender shaft 309 with a larger visible object 310 at the top 311, such as a ball, flag, cone, or other easily visible object. In the most preferred embodiment, the large objects 310 atop position marker 307 are flags, balls, or cones of a bright color. Marker guides 308 are attached to rigid plate 301, preferably by welding. Typically, marker guides 308 have aligned holes 406, which hold position markers 307 upright.

Figure 3:
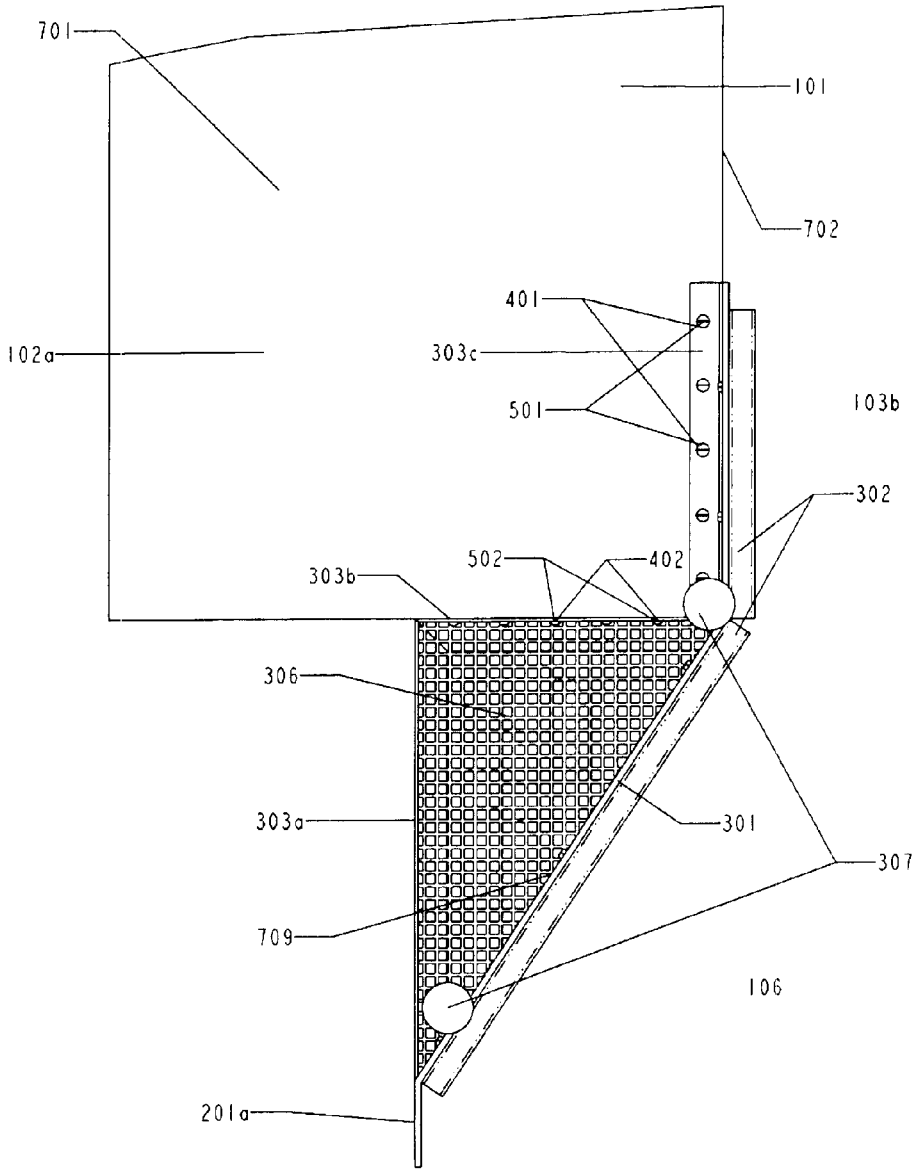
FIG. 3 is an orthographic top view showing the invention attached to the end of a dock.

FIG. 3 shows a top view of the end 102*a* of the dock 101, with the guide 201*a* attached. In this view, the rigid plate 301 can be seen conforming to the side 702 of the dock end 102*a*, and angling from the slip 103*b*, providing a wider opening 106 for the watercraft 104 (shown in FIG. 1) than would occur if only the dock 101 were present. Attached to the plate 301 are energy absorbing rails 302. On the backside 709 of the rigid plate 301 are structural members 303*a, b*, and *c* which enhance the rigidity of the guide system 201*a* and allow it to be attached to the dock 101. Extension member 303*a* is attached to the rigid plate 301 at a point farthest from the dock 101, and is also attached to the bracing member 303*b*. Bracing member 303*b* is also attached to the rigid plate 301, and holes 402 in bracing member 303*b* allow attachment to the dock 101 using screws 502 or bolts. Attachment member 303*c* sits on the top surface 701 of the dock 101, with holes 401 therein through which bolts or screws 501 are placed to secure the guide system 201*a* to the dock 101 top surface 701. Attachment member 303*c* is also secured to the rigid plate 301, typically by welding. Position markers 307 and screen 306 are also shown. Screen 306 sits on structural members 303*a* and 303*b*, and may also be attached to rigid plate 301 and structural members 303*a* and 303*b* by welding. Screen 306 prevents objects or people from falling through the back of the angled guide 201*a*.

Figure 4:
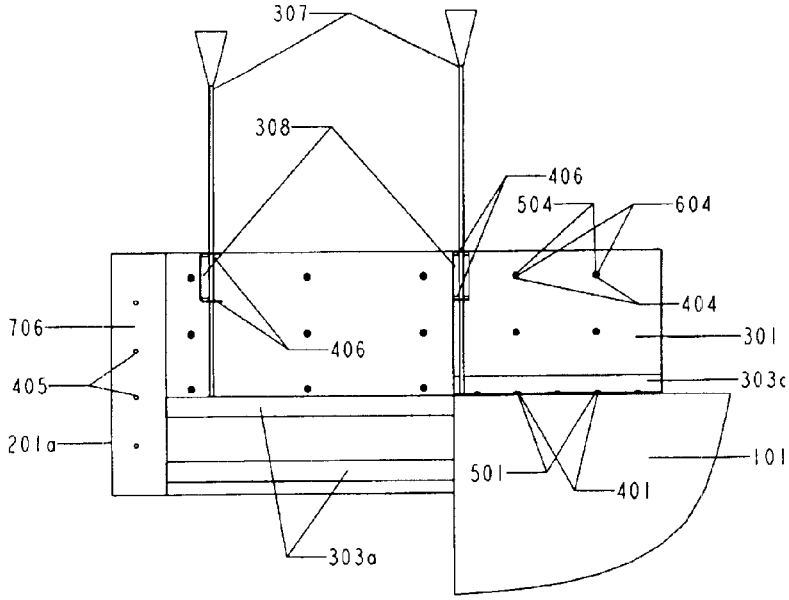
FIG. 4 is an orthographic side view of the invention, from the back side nearest the dock, wit e invention attached to the dock.
Figure 8:
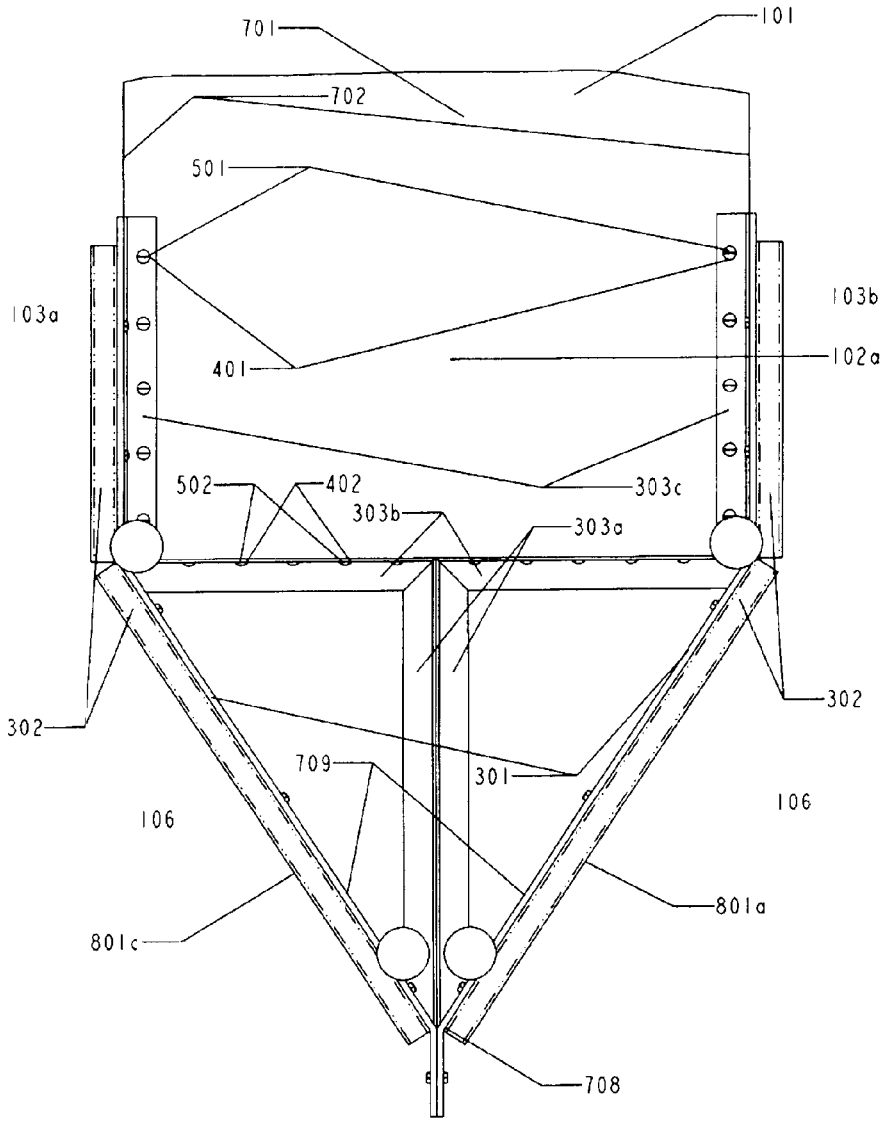
FIG. 8 is an orthographic top view showing an alternative embodiment of the invention attach d to both sides of the end of a dock.
Figure 9:
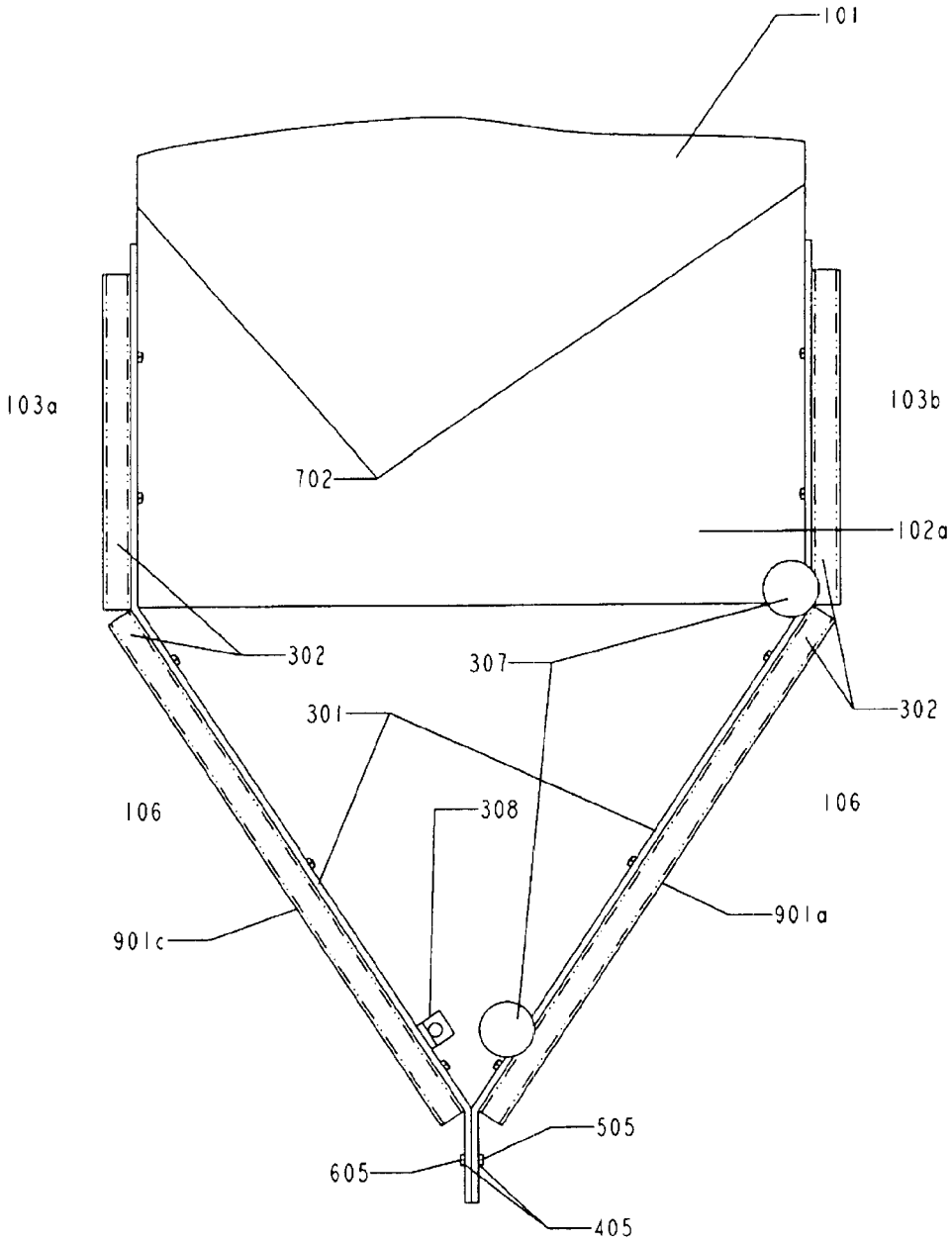
FIG. 9 is an orthographic top view of additional alternative embodiments of the invention attached to both sides of the end of a dock.

FIG. 4 shows a partial view of the guide 201*a* looking at the backside 709 of the plate 301 while attached to the dock 101. The rigid plate 301 has attached to it extension members 303*a* and attachment member 303*c*, as well as bracing members 303*b* (shown in FIG. 3). Typically this attachment is accomplished through welding. Also attached to plate 301 are energy absorbing rails 302 (shown in FIG. 3). Holes 404 through the plate 301 and rails 302 allow bolts 504 and nuts 604 to attach energy absorbing rails 302 to the plate 301. Position markers 307 are shown, inserted through holes 406 in marker guides 308. Also shown in this view are holes 405 in the extension surface 706 of the plate 301 which allow left 201*a* and right 201*b* guides to be connected using bolts 505 and nuts 605, or similar mechanical fasteners when both are attached to the end 102*a* of a dock 101, as shown in FIGS. 8 and 9.

Figure 5:
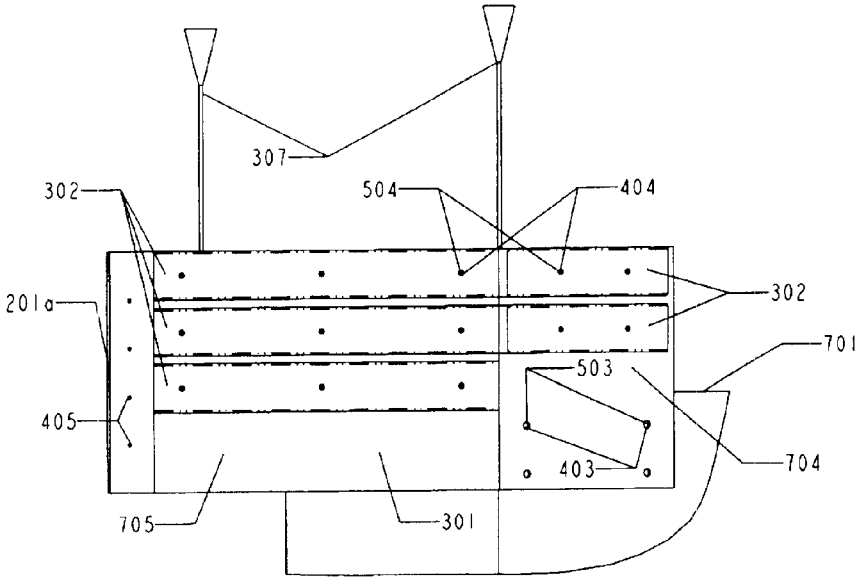
FIG. 5 is an orthographic projected view of the invention, looking directly at the front side of the angled plate portion of the invention.

FIG. 5 shows another view of the angled guide 201*a*, looking squarely at the angled surface 705 of the rigid plate 301. Energy absorbing rails 302 are attached to the angled surface 705 and side surface 704 of the rigid plate 301. The rigid plate 301 extends above and below the top surface 701 of the dock 101. Holes 404 for bolts 504 and nuts 604 (shown if FIG. 4), or screws which attach energy absorbing rails 302 to rigid plate 301 are also seen in this view. Position markers 307 are also illustrated in this view. Holes 405 for connecting adjacent pairs of angled guides 201*a* and 201*b* (as shown in FIGS. 8 and 9) are present in the rigid plate 301. Holes 403 are also present in the plate 301 which allow for direct attachment of the plate 301 to the dock 101 using screws 503 or bolts.

Figure 6:
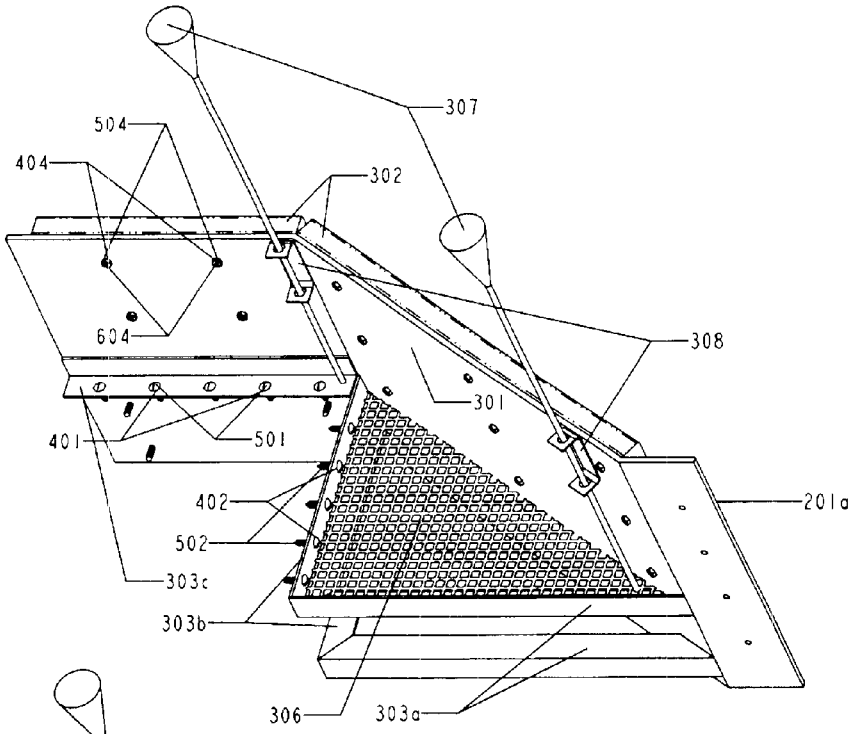
FIG. 6 an isometric view of the back side of the invention, ready to be mounted to a dock.

FIG. 6 shows only the angled guide 201*a* from the back, ready for attachment to a dock 101. Rigid plate 301 has attached to it energy absorbing rails 302. Attachment member 303*c*, extension members 303*a*, and bracing members 303*b* are all attached to the rigid plate 301. Holes 404 in the plate 301 and the energy absorbing rails 302 allow for bolts 504 and nuts 604, or screws to attach the rails 302 to the plate 301. Holes 401 in the attachment member 303*c* are also shown. Screws 501, or similar mechanical hardware secure the angled guide 201*a* to a dock 101 through these holes 401. Marker guides 308 are attached to rigid plate 301, and hold position markers 307 upright. A screen 306 sits on top bracing member 303*b* and top extension member 303*a* to prevent objects, or people from falling through the space between the dock 101 and the rigid plate 301. Holes 402 for screws 502, or similar mechanical attachment of bracing member 303*b* to dock 101 are also shown in this view.

Figure 7:
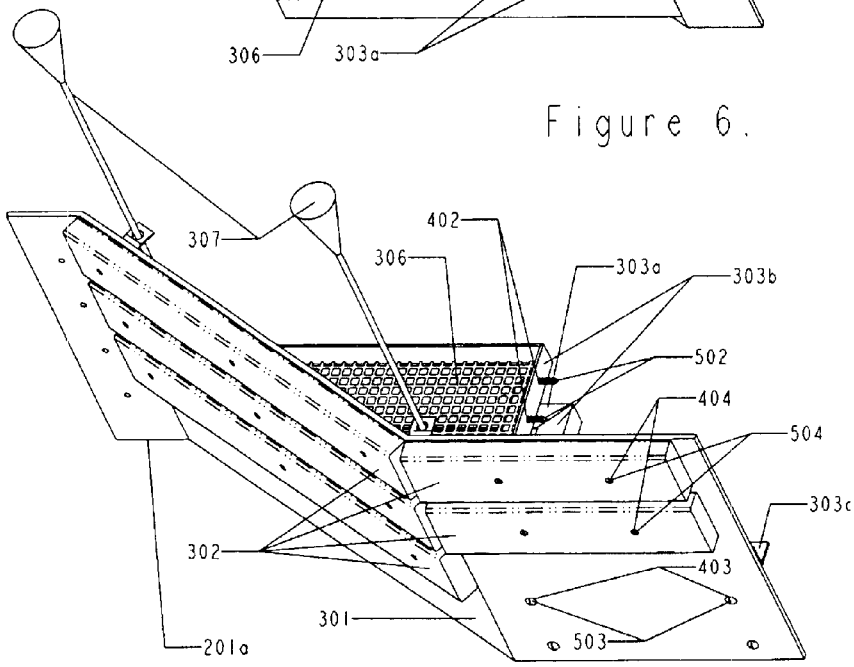
FIG. 7 is an isometric view of the front side of the invention, ready to be mounted to a dock.

FIG. 7 shows only the angled guide 201*a* from the front, ready for attachment to a dock 101. Rigid plate 301 has attached to it energy absorbing rails 302. Attachment member 303*c*, extension members 303*a*, and bracing members 303*b* are all attached to the rigid plate 301. Holes 404 in the rigid plate 301 and energy absorbing rails 302 allow for bolts 504 and nuts 604, or similar mechanical hardware to attach the rails 302 to the rigid plate 301. Holes 402 in the bracing members 303*b* are also shown. Screws 502 or similar mechanical hardware secure the angled guide 201*a* to a dock 101 through these holes 402. Holes 403 in the rigid plate 301 are also shown in this view, which allow direct attachment of the rigid plate 301 to the dock 101 using screws 503, if desired. Position markers 307 and screen 306 are also visible in this view.

FIG. 8 shows left 801*a* and right 801*c* angled guides attached to the end of a dock 101. The dock end 102*a* divides two slips 103*a* and 103*b* and left guide 801*a* guides watercraft 104 into the right slip 103*b* and right guide 201 c guides watercraft 104 into the left slip 103*a*. In this view, the rigid plates 301 can be seen conforming to the sides 702 of the dock end 102*a*, and angling from the slips 103*b*, providing a wider opening 106 for the watercraft 104 than would occur if only the dock 101 were present. Attached to the plates 301 are energy-absorbing rails 302. On the backsides 709 of the rigid plates 301 are structural members 303*a*, 303*b*, and 303*c*, which enhance the rigidity of the guides 801*a* and 801*c*, and allow them to be attached to the dock 101. Extension members 303*a* are attached to the rigid plates 301 at a point near the bend 708 farthest from the dock 101, and are attached to the bracing members 303*b*. Bracing members 303*b* are also attached to the plates 301, and holes 402 in bracing members 303*b* allow attachment of the guides 801*a* and 801*c* to the dock 101 using screws 502 or similar mechanical hardware. Attachment members 303*c* sit on the top surface 701 of the dock 101, with holes 401 therein through which bolts or screws 501 are placed to secure the guides 801*a* and 801*c* to the dock 101. Attachment member 303*c* is also secured to the rigid plates 301. Position markers 307 are also shown in this view.

FIG. 9 shows alternative embodiments of left 901*a* and right 901*c* angled guides attached to the end 102*a* of a dock 101. In this view, the rigid plates 301 can be seen conforming to the sides 702 of the dock 101, and angling from the slips 103*a* and 103*b*, providing a wider opening 106 for the watercraft 104 than would occur if only the dock 101 were present. Attached to the plates 301 are energy-absorbing rails 302. Notably absent in these embodiments are the structural members 303*a, b*, and *c* of the preferred embodiment angled guides 201*a* and 201*b*, which normally allow them to be attached to the dock 101. In this embodiment, the rigid plates 301 are attached directly to the dock 101 using screws 503 or other mechanical fasteners through holes 403, which are visible in views 2, 5, 6, and 7. Structural rigidity is provided by the two rigid plates 301 being joined together using bolts 505 and nuts 605, or other mechanical fasteners where they meet, furthest from the dock end 102*a*. Bolts 505 or similar mechanical fasteners pass through holes 405 in each plate 301, connecting plates 301 together. Alternatively, rigid plates 301 could be welded or otherwise attached to one another where they meet without holes and mechanical fasteners. Position markers 307 and marker guide 308 are also shown in this view, in a varied configuration.

A variety of materials and methods of manufacture are available for the various embodiments of the invention. The preferred embodiment of the invention utilizes formed plate steel for the rigid plate 301, angle iron for the attachment 303*c*, bracing 303*b*, and extension 303*a* members, and a composite plastic material commonly available for decking for the energy absorbing rails 302. The attachment 303*c*, bracing 303*b*, and extension members 303*a* are welded to the rigid plate 301 and to one another in the preferred embodiment, and the attachment of the rails 302 to the plate 301 and the attachment of the entire guide assembly 201*a* to the dock 101 is accomplished using bolts, nuts, and screws 501–505 and 604–605. Although structural members 303*a* and 303*b* are shown at right angles to one another, a variety of angles might be used to accomplish the objectives of the invention, and could be substituted without departing from the concept of this invention. Similarly, only one structural member 303 might be used, or one set of structural members 303*a, b*, and *c* including one bracing member 303*b* and one extension member 303*a*. While angle iron is shown, flat or round bar stock might be used. In some cases, automotive shock absorbers or similar energy absorbing devices might be used as structural members 303*a, b*, or *c*, which would actively absorb energy. In such a case the rigid plate 301 would also be hinged where bends 707 and 708 have been illustrated in the figures to better allow active movement for energy absorption. Energy absorbing rails 302 illustrated in the figures may vary in number and position on the rigid plate 301 to accommodate a variety of watercraft 104 at the level they ride above the water 105. Other materials, and joining and mounting methods known in the art may also be used to achieve the objects of the invention.

The described embodiments are to be considered in all respects only as illustrative of the current best mode of the invention known to the inventor at the time of filing the patent application, and not as restrictive. The scope of the invention is, therefore, indicated by the appended claims rather than by the foregoing description. All devices that come within the meaning and range of equivalency of the claims are to be embraced within the scope of this patent.

What is claimed is:

1. A guide which facilitates the moving of a watercraft into a slip area, the slip area being defined by inside dock surfaces which face the watercraft when in the slip area, the dock having a top surface above the water and at least one end surface which faces away from the dock end and the slip area, the guide comprising:

a rigid plate attached to the dock, said rigid plate having a front side and a back side, and said rigid plate extending upwardly beyond the top surface of the dock; wherein said front side of said rigid plate has a first planar surface, and wherein said first planar surface of said rigid plate angles outwardly away from the slip beyond the end of the dock.

2. The guide of claim 1, further comprising:

at least one energy absorbing rail attached to the front side of said rigid plate.

3. The guide of claim 2, further comprising:

at least one structural member attached to said back side of said rigid plate and attached to the dock.

4. The guide of claim 3, wherein said rigid plate is hinged.

5. The guide of claim 4, wherein said at least one structural member is attached to the dock and to said plate, and wherein said structural member allows hinged movement said plate relative to the dock, while damping said motion.

6. The guide of claim 3, further comprising:

a second planar surface of said front side of said rigid plate, positioned within the slip area.

7. The guide of claim 6, wherein said at least one structural member attached to said back side of said rigid plate further comprises:

at least one attachment member attached to said backside of said rigid plate for attachment of said rigid plate to the dock;

at least one extension member attached to said back side of said rigid plate to support said rigid plate and limit its movement relative to the dock; and at least one bracing member attached to said rigid plate and to said extension member to limit flexing of the rigid plate, and to attach said rigid plate to the dock.

8. The guide of claim 7, wherein:

said at least one energy absorbing rail is attached to first planar surface of said rigid plate; and wherein at least one of any additional energy absorbing rails is attached to second planar surface of said rigid plate.

9. The guide of claim 8, wherein said rigid plate comprises a steel material, and wherein said energy absorbing rails comprise a plastic composite material, and wherein said attachment members, bracing members, and extension members comprise an angle iron material.

10. A guide which facilitates the moving of a watercraft into a slip area, the slip area being defined by inside dock surfaces which face the watercraft when in the slip area, the dock having a top surface above the water and at least one end surface which faces away from the dock end and the slip area, the guide comprising:

a rigid plate having a front side and a back side, said rigid plate extending upwardly beyond the top surface of the dock, wherein said front side of said rigid plate has a first planar surface which angles outwardly away from the slip beyond the end of the dock;

at least one energy absorbing rail attached to the front side of said rigid plate; and at least one structural member attached to said back side of said rigid plate and attached to the dock.

11. A dock with inside surfaces which define at least one slip area to receive watercraft, the dock having a top surface above the water, comprising:

a guide surface which the watercraft engages when approaching the slip off-course, the guide surface oriented to angle outwardly from the slip area, providing a wider opening beyond the slip than within the slip, wherein the guide surface extends upward beyond the top surface of the dock.

* * * * *